US007485154B2

(12) United States Patent
McGee et al.

(10) Patent No.: US 7,485,154 B2
(45) Date of Patent: Feb. 3, 2009

(54) TEXTILE TREATMENT COMPOSITIONS INCLUDING A SUBLIMABLE MATERIAL

(75) Inventors: Thomas McGee, Nyack, NY (US); Richard P. Sgaramella, Hoboken, NJ (US)

(73) Assignee: Givaudan SA, Vernier (CH)

( * ) Notice: Subject to any disclaimer, the term of this patent is extended or adjusted under 35 U.S.C. 154(b) by 302 days.

(21) Appl. No.: 10/531,803

(22) PCT Filed: Oct. 14, 2003

(86) PCT No.: PCT/CH03/00670

§ 371 (c)(1),
(2), (4) Date: Apr. 18, 2005

(87) PCT Pub. No.: WO2004/037964

PCT Pub. Date: May 6, 2004

(65) Prior Publication Data

US 2006/0010933 A1 Jan. 19, 2006

Related U.S. Application Data

(60) Provisional application No. 60/420,758, filed on Oct. 23, 2002, provisional application No. 60/420,159, filed on Oct. 22, 2002.

(51) Int. Cl.
*D06M 23/00* (2006.01)

(52) U.S. Cl. ..... 8/115.6; 8/137; 8/149.2

(58) Field of Classification Search ..... 252/14, 252/49.6; 428/375; 528/75; 512/4; 8/115.6, 8/137, 149.2
See application file for complete search history.

(56) References Cited

U.S. PATENT DOCUMENTS

| | | | | |
|---|---|---|---|---|
| 3,903,022 | A | 9/1975 | Ohara et al. | 252/522 |
| 4,233,161 | A | 11/1980 | Sato et al. | 252/1 |
| 4,301,043 | A * | 11/1981 | Sato et al. | 512/4 |
| 4,382,111 | A * | 5/1983 | Kuwayama et al. | 428/375 |
| 4,749,681 | A | 6/1988 | Evers et al. | 512/8 |
| 6,852,824 | B2 * | 2/2005 | Schwarte et al. | 528/75 |

FOREIGN PATENT DOCUMENTS

EP 0 118 625 9/1984

OTHER PUBLICATIONS

Database WPI; Section Ch, Week 199029; Derwent Publications Ltd., London, GB; Class D25, AN 1990-219881; XP002267051 & JP 02 147699 A (Nippon Soda CO), Jun. 6, 1990; abstract.

* cited by examiner

*Primary Examiner*—Lorna M Douyon
*Assistant Examiner*—Amina Khan
(74) *Attorney, Agent, or Firm*—Norris McLaughlin & Marcus, PA

(57) ABSTRACT

A textile treatment delivery system adapted to impart textile conditioning composition and fragrance to a fabric while it is being dried in a heated drier, the delivery system comprising at least one textile conditioning composition and at least one fragrance in a sublimable carrier substance. The treatment is efficient and leaves virtually no residue.

1 Claim, No Drawings

TEXTILE TREATMENT COMPOSITIONS INCLUDING A SUBLIMABLE MATERIAL

This application is a 371 of PCT/CH03/00670 filed Oct. 14, 2003, which claims the benefit of U.S. Provisional Application No. 60/420,159, filed Oct. 22, 2002, and U.S. Provisional Application No. 60/420,758, filed Oct. 23, 2002.

The present invention generally relates to textile treatment compositions and a delivery system therefor, which delivery system comprises a sublimable material containing one or more textile conditioning compositions and at least one fragrance composition, which compositions are especially useful in the treatment of fabrics in a heated drier device.

It is known in the art to provide one or more textile conditioning compositions, such as fabric softener compositions, fragrances, anti-static compositions and wrinkle diminishing compositions, to fabrics, typically in the form of textiles or garments, which are being dried in a heated drier device, such as a clothes drier. In such a device, the fabrics to be dried are tumbled in a rotating drum through which a stream of heated air is passed, and they are treated in the drum with one or more textile conditioning compositions. In operation, it is intended that the heated air dries the fabrics, and at the same time these fabrics are contacted with, and treated by the textile conditioning compositions. One known way of achieving such an effect is to put in the drum with the fabric a substrate containing the textile conditioning compositions. The substrate is typically a woven or nonwoven sheet containing a quantity of the textile conditioning compositions. The presence of such sheets can cause problems. For example, they can become entangled with the fabric, and fail adequately to distribute the textile conditioning compositions. In addition, if a volatile fragrance is present (as is usually the case), fragrance is lost during both manufacture and storage of the sheets. Another disadvantage is that such sheets have to be manually recovered, when drying is finished. One proposed solution has been the use of gel-based materials. However, these have the disadvantage that they invariably leave some residue on the treated fabric.

It has now been found that it is possible substantially or completely to overcome these problems and provide a composition that is easy to use, that leaves no visible residue and that can avoid the need to be recovered. The invention therefore provides a textile treatment delivery system adapted to impart textile conditioning composition and fragrance to a fabric while it is being dried in a heated drier, the delivery system comprising at least one textile conditioning composition and at least one fragrance in a sublimable carrier substance.

The invention additionally provides a method of providing textile conditioning and fragrance to a fabric that is being dried in a heated drier, comprising the addition to the fabric in the drier of at least one textile conditioning composition and at least one fragrance in a sublimable carrier substance.

Sublimable materials are known to be useful in some air freshener compositions, but there is no known previous use in conjunction with textile treatment aids.

Such delivery systems minimize the loss of contained fragrances in manufacture and storage, especially the highly volatile fragrance constituents which provide "topnotes" in the fragrance spectrum. They also leave little or no readily visible residue upon the treated fabrics.

The sublimable carrier substance, which may be a mixture of such substances, is compatible with the textile conditioning compositions and fragrances that are required in the delivery system. It should preferably be one that has a sublimation temperature in the operating temperature range of the drier.

This is typically in the range of from 40° C. to 80° C., According to one preferred embodiment, the sublimable carrier substance exhibits a sublimation temperature in the range of from 40° C. to 65° C., but more preferably from 50° C. to 60° C. However, higher or lower temperatures may also be used and the sublimable carrier substance selected such that it exhibits a sublimation temperature which falls within the desired range.

Any sublimable material that exhibits the abovementioned characteristics may be used as a sublimable carrier substance in accordance with one or more aspects of the present invention, and examples of suitable sublimable materials include those described in U.S. Pat. No. 4,233,161 and in U.S. Pat. No. 3,903,022 the contents of which are herein incorporated by reference. For example the sublimable materials may be sublimable hydrocarbons e.g., adamantane, endo-trimethylenenorbomane, cyclododecane, trimethylnorbornane, norbornane, naphthalene, and the like, as well as sublimable polar compounds e.g., dimethyl fumarate, benzoic acid, trioxymethylene, cumarin, p-dichlorobenzene, caprolactam, 1,4-cyclohexanediol, phthalide, lactide, triisopropyltrioxane and the like.

Preferred sublimable carrier substances useful in the delivery system according to the invention are those which have a molecular weight of 200 maximum, more preferably of 170 maximum. Preferred sublimable materials include those which exhibit low odour or no discernable odour at their sublimation temperatures so as not to mask undesirably any fragrance constituent that may be present, or that would impart an undesirable malodour to the treated textiles.

Where a plurality of sublimable materials is to be used in the delivery system, desirably each of the sublimable materials is non-reactive in the presence of the other sublimable materials used. Also desirably the sublimation temperatures of each of the sublimable materials does not differ from the other sublimable materials present by more than 45 deg. C., preferably by no more than 40 deg. C., more preferably by no more than 35 deg. C. For example, adamantane (tricyclo(3,3,1,$1^{3,7}$) decane) is a non-toxic and odourless sublimable material. As compared with other sublimable hydrocarbons, its shape retention after moulding is good and the mechanical strength of a moulding formed thereof is high. Furthermore, it can hold a relatively large amount of textile conditioning compositions in the spaces between its crystalline particles. Therefore, adamantane is preferred for use in the delivery systems of the present invention, and delivery systems that include at least 50% wt. adamantane are especially preferred embodiments of the invention. However it has been observed that the ability of adamantane to retain textile treatment compositions may be further improved by combining it with at least one further sublimable material, especially one or more sublimable polar compounds.

Certain further preferred sublimable materials may include one or more materials selected from the group which includes: alicyclic hydrocarbons, which may be saturated or unsaturated or optionally substituted by one or more groups such as oxygen or nitrogen, for example, trimethylene norbonane (molecular wt. 136.13); cyclic hydrocarbons which may be saturated or unsaturated or optionally substituted by one or more groups such as oxygen and nitrogen, e.g., cyclodecane (molecular wt. 168.32), tetrahydrodicyclopentadiene (molecular wt. 136.21) camphor (molecular wt. 152.12); aliphatic or aromatic organic acids, e.g., dimethyl fumarate (molecular wt. 144.13), benzoic acid (molecular wt. 122.12), as well as trioxane. These materials are presented by way of example only and other suitable materials may also be used.

The proportion of sublimable material present in the delivery system may be any effective amount. It is preferably not more than 60% wt., more preferably not more than 50% wt., and still more preferably not more than 40% wt. of the total weight of the textile treatment delivery system of which it forms a part.

In addition to the delivery system, the compositions of the invention comprise at least one fragrance constituent, and one further textile conditioning composition, which may be selected from any of those known to the art, preferably from fabric softener compositions, anti-static compositions, and compositions that provide simultaneous fabric softening and anti-static benefits to treated fabrics.

Anti-static compositions facilitate in the reduction of the "static cling" of treated fabrics. Static cling is caused by electrical charges that are induced on the surface of the fabrics by their rubbing together, which causes them to adhere together. These electrical charges can also cause lint, dust, and other undesired substances to stick to the fabric. The effect is most noticeable on freshly laundered unsoftened fabrics that are dried in hot air drier with a tumbling action.

Anti-static compositions, which may be used in the inventive compositions, may be any of those which are presently known and used in the art relating to liquid and solid detergent and fabric care compositions. Non-limiting, illustrative examples of anti-static compositions include those that are based on quaternary ammonium compounds, including quaternary ammonium compounds which comprise one or more relatively long aliphatic chains. Illustrative examples include those which may be represented by the structure:

$$(R)(R_1)(R_2)(R_3)N^+X^-$$

wherein R is benzyl, or lower(alkyl) benzyl; $R_1$ is alkyl of 10 to 24, preferably 12 to 22 carbon atoms; $R_2$ is $C_{10}$-$C_{24}$-alkyl, $C_1$-$C_4$-alkyl, or ($C_2$-$C_3$)hydroxyalkyl, $R_3$ is $C_1$-$C_4$-alkyl or ($C_2$-$C_3$)hydroxyalkyl and X represents an anion capable of imparting water solubility or dispersibility including chloride, bromide, iodide, sulfate and methosulfate. Particularly preferred species of these aliphatic quats include n-$C_{12}$-$C_{18}$-alkyl-dimethylbenzylammonium chloride (myristylalkonium chloride), n-$C_{12}$-$C_{14}$-alkyldimethyl(ethylbenzyl) ammonium chloride ("quaternium 14"), dimethyl(benzyl) ammonium chloride and mixtures thereof. These compounds are commercially available from a variety of sources either singly, or in mixtures. Other exemplary useful aliphatic quats include those wherein both R and $R_1$ are ($C_8$-$C_{24}$)alkyl, e.g., the N,N-di-(higher)-$C_{10}$-$C_{24}$-alkyl-N,N-di(lower-$C_1$-$C_4$)-alkyl-quaternary ammonium salts such as distearyl(dimethyl) ammonium chloride, di-hydrogenated tallow(dimethyl)ammonium chloride, di-tallow-(dimethyl)ammonium chloride (e.g., commercially available as Arquad® 2HT, ex. Akzo-Nobel), distearyl(dimethyl)ammonium methylsulfate and di-hydrogenated-tallow(diemthyl) ammonium methyl sulfate (commercially available as Varisoft® 137, ex. Sherex).

Still further examples of useful quaternary ammonium anti-static agents include the acid salts of (higher(alkyl)-amido(lower)alkyl)-dialkyl)-amines of the general formula:

$$[(A(C{=}O)—Y)—N(R_1)(R_2)(R_3)]^+X^-$$

wherein A is a $C_{14}$-$C_{24}$ straight or branched alkyl group, Y is ethylene, propylene or butylene, $R_1$ and $R_2$ are individually H, $C_1$-$C_4$ (lower)alkyl or ($C_1$-$C_3$)hydroxyalkyl or together form the moiety —$CH_2$—$CH_2YCH_2$—$CH_2$—, wherein Y is NH, O or $CH_2$; $R_3$ is the same as $R_1$ or is also [A(C=0)Y—], and X is the salt of an organic acid. Examples of such compounds include, inter alia, isostearamidopropyl(dimethyl)amine lactates, isostearamidopropy(morpholinium)lactate, cocamidopropyl(dimethyl)amine propionate, ditallowdiamido methosulfate, (methyl-1-tallow-amido)ethyl-2-tallow imidazolinium methyl sulfate, (methyl-1-oleylamido)ethyl-2-oleyl imidazolinium methyl sulfate, tallow imidazolinium methosulfate as well as alkylimidazolinium methosulfate. Still further useful amine salts are the stearyl amine salts that are soluble in water which include, inter alia, stearyl-dimethylamine hydrochloride, distearyl amine hydrochloride, decyl pridinium bromide, the pyridinium chloride derivative of the acetylaminoethyl esters of lauric acid, lauryl trimethyl ammonium chloride, decylamine acetate and bis-[(oleoyl)-(5,8)-ethanoloxy]-tallow($C_{14}$-$C_{18}$)amine hydrogen phosphate.

Still further anti-static agents include the series of sulfonated polymers available as Versaflex® 157, Versaflex® 207, Versaflex® 1001, Versaflex® 2004 and Versaflex(® 7000 (ex. National Starch and Chemical Company, Bridgewater, N.J.).

It is to be understood that the anti-static compositions described above are provided by way of illustration and are not intended by way of limitation.

Fabric softener compositions provide a treated fabric with a softness and/or a handle that is smooth and helps the drape of the fabric, and increases the comfort to the wearer of a treated garment. Such treated fabrics additionally have fewer wrinkles are often easier to iron. Fabric softener compositions which may be used in the inventive compositions may be any of those which are presently known and used in the art relating to liquid and solid detergent and fabric care compositions. Non-limiting, illustrative examples of fabric softener compositions include those based on cationic, nonionic, amphoteric and/or anionic fabric softening compounds, and may include compounds which simultaneously also provides an anti-static and/or other fabric conditioning benefit.

Examples of cationic fabric softening compounds include dialkyl cationic actives, monoalkyl cationic actives, and mixtures thereof. The dialkyl cationic active in the composition may be, for example, dialkyldimethyl ammonium chloride, dialkyldimethyl ammonium methyl sulfate, di (hydrogenated tallow) dimethyl ammonium chloride, dihexadecyldiethylammonium chloride, distearyldimethylammonium chloride, dibehenyldimethylammonium chloride, di (coconut alkyl) dimethyl ammonium chloride, ditallowdimethyl ammonium chloride, ester quaternium compounds, dialkylyloxy dimethyl ammonium chloride, N, N-di (tallowyl-oxy-ethyl)-N N-dimethylammonium chloride, N,N-(ditallowoxyl-oxyethyl)-N,N-dimethyl ammonium chloride, dialkyl imidazolium methyl sulfate, amido silicones, and mixtures thereof. The monoalkyl cationic active may be selected from cetyl trimethyl ammonium chloride, stearyl trimethyl ammonium chloride, and mixtures thereof. Many of these compounds may also provide a simultaneous anti-static benefit as noted above. Such cationic active-based fabric softener compounds may be used in conjunction with one or more water-insoluble oils. Such may include mineral oils, ester oils, sugar ester oils or oily sugar derivatives, natural oils, such as vegetable oils, and mixtures thereof.

Examples of nonionic fabric softening compounds include those that have an HLB of from about 2 to about 9, more typically from about 3 to about 7. In general, the materials selected should be relatively crystalline and exhibit higher melting points or melting ranges, e.g., greater than 25° C. Further examples of nonionic fabric softening compounds include fatty acid partial esters of polyhydric alcohols, or anhydrides thereof, wherein the alcohol, or anhydride, contains from 2 to 18, preferably from 2 to 8, carbon atoms, and each fatty acid moiety contains from 8 to 30, preferably from 12 to 20, carbon atoms. Typically, such softeners contain from one to 3, preferably 2 fatty acid groups per molecule. The polyhydric alcohol portion of the ester can be ethylene glycol, glycerol, poly (e.g., di-, tri-, tetra, penta, and/or hexa-) glycerol, xylitol, sucrose, erythritol, pentaerythritol, sorbitol or sorbitan. The fatty acid portion of the ester is normally derived from fatty acids having from about 8 to about 30, preferably from 12 to 22, carbon atoms. Typical examples of said fatty acids include lauric acid, myristic acid, palmitic acid, stearic acid, oleic acid, and behenic acid, as well as derivatives of one or more of these fatty acids.

Further examples of useful nonionic based fabric softening compounds include those based on glycerol and polyglycerol esters, for example, glycerol, diglycerol, triglycerol, and polyglycerol mono- and/or di- esters. Partial esters of glycerin can also be ethoxylated to form usable derivatives and are to be considered as useful forms of glycerol esters. The polyglycerol esters comprise diglycerol esters through octaglycerol esters. Examples of specific glycerol esters and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc. and often such materials are provided as technical grade mixtures containing two or more specific glycerol and polyglycerol esters.

The textile conditioning composition may be present in any effective amount. Advantageously the textile conditioning composition comprises not more than about 80% wt., preferably not more than 60% wt., more preferably not more than 50% wt. of the total weight of the textile treatment compositions of which they form a part.

In addition to the delivery system and the textile conditioning composition, the compositions of the invention include at least one fragrance composition. The fragrance composition may be any material that will leave the fabric smelling pleasant, and that is capable of surviving the heat of a clothes drier. All known art fragrance compositions may be considered for use in the inventive compositions and the selection of suitable fragrance compositions will be readily determinable by the skilled formulator. Preferably the fragrance compositions will include one or more aroma chemicals that exhibits a low vapour pressure, as well as one or more aroma chemicals that exhibit a high vapour pressure. As is known to the art, the vapour pressure of an aroma chemical is related to its boiling point, and both vapour pressure and boiling point may be measured or calculated using one of the commercially available software programs, such as ACD Software, ACD/Boiling Point calculator version 4.0.

The selection of the aroma chemicals that are combined to form a fragrance composition should be such that the fragrance composition does not unduly evapourate during the drying cycle of a clothes drier within which the fabrics are treated, so that sufficient aroma chemicals are present to provide a lasting scent on the treated fabrics. Advantageously, the fragrance constituent will contain a major proportion of high boiling point (low vapour pressure) aroma chemicals, preferably with low perception thresholds, in addition to a minor proportion of lower boiling point (higher vapour pressure) aroma chemicals that are useful for providing a fragrance to the textile treatment composition, such that at least a portion of which will survive the drying cycle of a clothes drier and still provide a perceptible fragrance to fabrics treated by the inventive compositions. Perfumers skilled in the art will formulate their fragrances such that the composition will have a desirable odour and leave the treated articles smelling clean and fresh after treatment. Preferably, at least 50% wt. of the fragrance constituent consists of aroma chemicals having a vapour pressure of less than 0.1 mm Hg at 25 C., and more preferably these will also exhibit a threshold of less than 5 nanograms per liter.

Many of the art-recognized perfume compositions are relatively substantive, as described hereinafter, to maximize their odour effect on fabrics. A substantive perfume is one that contains a sufficient percentage of substantive perfume ingredients so that when the perfume is used at normal levels in products, it deposits a desired odour on the treated fabric. Substantive perfume materials are those that deposit on fabrics via the drier-added product in the tumble drying process and are detectable by people with normal olfactory acuity. Such materials typically have vapour pressures lower than that of the average perfume material.

Perfumes can be classified according to their volatility. The volatile, low boiling perfume ingredients typically have boiling points lower than about 250° C. These ingredients are usually lost in the tumble drying process. Less volatile perfume ingredients having boiling points of from about 250° C. or higher are more substantive. Many of the perfume ingredients as discussed hereinafter, along with their odour characters and their physical and chemical properties, such as boiling point and molecular weight, are given in "Perfume and Flavor Chemicals (Aroma Chemicals)," Steffen Arctander, published by the author, 1969, the contents of which are incorporated herein by reference.

Examples of the volatile, low boiling, perfume ingredients are: anethole, benzaldehyde, benzyl acetate, benzyl alcohol, benzyl formate, iso-bomyl acetate, camphene, cis-citral (neral), citronellal, citronellol, citronellyl acetate, para-cymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of less volatile, high boiling perfume ingredients are: amyl cinnamic aldehyde, iso-amyl salicylate, benzophenone, benzyl salicylate, beta-caryophyllene, cedrene, cinnamic alcohol, coumarin, dimethyl benzyl carbinyl acetate, ethyl vanillin, ethylene brassylate, eugenol, iso-eugenol, flor acetate, galaxolide (1,3,4,6,7,8-hexahydro-4,6,6,7,8,8-hexamethyl-cyclopenta-gama-2-b-enzopyra n), heliotropine, 3-cis-hexenyl salicylate, hexyl cinnamic aldehyde, hexyl salicylate, lilial (para-tertiarybutyl-alpha-methyl hydrocinnamic aldehyde), lyral (4-(4-hydroxy-4-methyl pentyl)-3-cyclohexene-10-carboxaldehyde), methyl cedrylone, methyl dihydro jasmonate, gamma-methyl ionone, methyl-beta-naphthyl ketone, musk indanone, musk ketone, musk tibetene, nerolidol, patchouli alcohol, phenylethyl phenyl acetate, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

In general, the degree of substantivity of a perfume is roughly proportional to the percentage of substantive perfume material used. The free perfume useful in the composition of the present invention typically contains at least 10%, preferably at least 50%, more preferably at least 70%, by weight of the composition, of substantive perfume ingredients.

The fragrance constituent may be present in any effective amount. Advantageously the fragrance constituent comprises not more than 20% wt., preferably not more than 10% wt., and more preferably not more than 4% wt. of the total weight of the textile treatment compositions of which they form a part. It has been observed that the textile treatment compositions, according to particularly preferred embodiments, may provide an excellent fragrancing benefit to treated fabrics with a lower amount of fragrance constituent present in the textile treatment composition, as compared to other known fragranced textile treatment preparations or formulations.

In addition to the delivery system, the textile conditioning composition, and the fragrance composition, the inventive compositions may further include one or more further optional constituents, which may be selected from any of those that are known to the art relating to detergent and fabric care compositions. Examples of useful optional constituents include: ironing aid additives, anti-creasing agents (also referred to as wrinkle-release agents), anti-soil agents (also referred to as soil-release agents), bacteriostatic agents, germicides, antioxidants, optical brighteners, fluorescent agents, fiber emollients, finishing agents, mildew-proofing or moth-proofing agents, shrinkage controllers and sizing agents. One or more of these may be included in the present inventive compositions in effective amounts. Advantageously, the total amount of such optional constituents, when present, is not more than 10% wt., preferably not more than 2% wt. of the total weight of the textile treatment compositions of which they form a part.

The inventive compositions are particularly suited for imparting the fabric treatment composition to fabrics. Generally, the method of using the articles of the present invention comprises: commingling pieces of damp fabric by tumbling said fabric under heat, e.g., via a flow of hot air in an automatic clothes drier with an article comprising an effective amount of the softener composition of this invention.

With regard to the operation of the textile treatment compositions taught herein, while not wishing to be bound by the following, it is postulated that the combination of moisture that is released from the fabric being tumbled and dried, coupled with the mechanical action and heat, contributes to the sublimation of the delivery vehicle, which releases the textile conditioning composition and fragrance, as well as any further constituents, into the interior of the clothes drier and on to the fabric being treated in the clothes drier.

The textile treatment compositions may be provided in any of a number of forms including but not limited to beads, pellets, discs, plates, films, sheets, rods, powders, prills, and the like. The textile treatment compositions may also be provided within the interior of a carrier device, such as a tube, ball, bag, sachet or other article that is made of a material and/or includes a construction that permits for the escape of the constituents making up the textile treatment compositions from the interior of the carrier device to the interior of the clothes drier. For example, the textile treatment composition may be provided within a sachet or bag, which has at least one porous wall. This sachet or bag may be put into a clothes drier and allowed to tumble with the fabrics that are being dried. After drying, such a sachet or bag is normally easier to find than a sheet. Such a sachet or bag may be refillable and reusable. Also, it is contemplated that, prior to use, the sachet or bag may be immersed in water in order to saturate or moisten the porous wall; such a step provides additional moisture within the clothes drier, which may be advantageous with certain textile conditioning compositions. In another alternative, the textile treatment composition may be provided as one or more discrete units, for example, in the form of balls or discs that are sufficiently small to be manually handled, but that are larger than the vent holes typically found in the wall of a clothes drier drum. Such discrete units are conveniently used by putting in one or more of the units into the interior of the clothes drier, where they come into contact with the fabrics being dried. Such discrete units would be expected to sublimate during the drying cycle.

The textile treatment compositions according to the invention may be manufactured according to any suitable process. Two processes that are particularly useful are melt forming and compression moulding.

In a melt forming process, at least one of the materials used to form the textile treatment compositions is melted at a temperature preferably not in excess of about 10 deg. C. above its melting point, and then the remaining constituents used to form the textile treatment compositions are added thereto and the composition is well mixed to form a melt blend and subsequently allowed to cool. When still in a fluid or plastic state, the melt blend may be formed into any useful shape or form, such as a sheet, film, rod, ribbon or strand by any suitable means, such as casting, moulding or extrusion. Thereafter the shaped or formed textile treatment composition may be optionally further treated, such as by a mechanical treatment such as grinding which may comminute the formed textile treatment composition.

In a compression moulding process, the sublimable material is combined with the textile conditioning composition(s), fragrance constituent and any optional constituent(s), and they are well mixed to form a blend. Advantageously each of these is in a liquid, or finely divided form, such as pellets, powders and prills. Subsequently, this blend is compression moulded using conventional equipment in order to produce formed shapes. Any of a variety of formed shapes may be produced, inter alia, tablets, spheres, plates, discs, etc. Known art apparatus may be used in such a compression moulding process. In certain instances, compression moulding is preferred, as heating of any of the constituents making up the textile treatment composition is not required. This minimizes the risk of degradation of any of the constituents used to form the textile treatment composition, particularly the fragrance constituent.

One preferred embodiment may be manufactured by mixing the composition and any optional ingredients in a high shear mixer and extruding the mass and cutting into slices. Details of a suitable process are given in Example 1 below.

Another preferred embodiment may be manufactured according to a process comprising the steps of heating the composition and any optional ingredients and then pouring into moulds. Further details of a suitable process are set forth in the Example 2 below.

The invention will now be further described with reference to the following non-limiting examples, which describe preferred embodiments.

EXAMPLE 1

The following compositions were made by placing adamantane and a textile treatment composition active in a high shear mixer and blending until the mass was homogeneous. Arquad® 2HT is a commercially-available, quaternary ammonium-based textile conditioning composition (ex. Akzo-Nobel). The amount of each constituent is indicated in grams. A proprietary fragrance (ex Givaudan) was added and mixing was continued until the mass was uniform The resultant mass was stamped into 3.0 g tablets (approximately 5 mm thick and diameter 30 mm) in a tabletting machine operating at a compression pressure of about 2.76 MPa (400 psi).:

| Example: | 1-1 | 1-2 | 1-3 | 1-4 | 1-5 |
|---|---|---|---|---|---|
| adamantane | 1.4 | 0.2 | 0.1 | 1.3 | 1.4 |
| Arquad ® 2HT | 1.5 | 2.7 | 2.8 | 1.6 | 1.5 |
| fragrance | 0.1 | 0.1 | 0.1 | 0.1 | 0.1 |
| Tablet Hardness | 4 | 2 | 1 | 4 | 4 |

The tablets were assessed for hardness, where the ratings indicated: 1="crumbly soft" 2="soft tablet", and 4="hard tablet".

It was observed that, when the adamantane was present at around 40% or in excess thereof, a matrix exhibiting satisfactory hardness was obtained

EXAMPLE 2

Using the process outlined in Example 1, a homogenous mixture containing of 1.4 g of adamantane, 1.5 g of Arquad® 2HT and various amounts of the proprietary fragrance of Example 1 was prepared as shown in the Table below. The percentage of the total composition which the fragrance constituent forms, as well as the actual weight in grams of the proprietary fragrance in each of the example compositions is listed on the Table below. Each composition was mixed until homogeneous and then stamped into a tablet, as described above. The tablets were assessed for hardness as discussed previously; the results are indicated in the following table:

| Example | 2-1 | 2-2 | 2-3 | 2-4 | 2-5 | 2-6 | 2-7 | 2-8 | 2-9 | 2-10 | 2-11 |
|---|---|---|---|---|---|---|---|---|---|---|---|
| Fragrance | 1% | 2% | 3% | 4% | 5% | 6% | 7% | 8% | 9% | 10% | 11% |
| | 0.03 | 0.06 | 0.09 | 0.12 | 0.15 | 0.18 | 0.21 | 0.24 | 0.27 | 0.30 | 0.33 |
| Hardness | 4 | 4 | 4 | 4 | 4 | 4 | 3 | 3 | 3 | 2.5 | 1.5 |

EXAMPLE 3

A tablet of sublimable solid prepared from the formulation below:

| Example 3 | Wt. (grams) |
|---|---|
| adamantane | 1.4 |
| Arquad ® 2HT | 1.5 |
| Fragrance | 0.1 |

The Arquad® 2HT was heated with stirring to 80-85° C. in a glass beaker. The sublimable solid was added and stirred until homogeneous. The fragrance was added in at the end of the mixing process. The resulting liquid mixture was poured into a 3.0 g mould and cooled until solid. The 3 g tablets were removed for evaluation.

Subsequently, two loads of terry towelling was washed in laundry detergent and spun dry. One load was placed in tumble drier with a drier sheet containing fragrance containing an equal amount of the fragrance of Example I and the other with the tablet of the composition above. Both loads were dried on the "hot" cycle. The softness of the towelling and its fragrance were assessed by a panel of 5 people, which panel judged the treatment to the loads of terry towelling to be similar. No residue of the tablet was found.

These results demonstrate that the composition provides an excellent textile treatment benefit as compared to the drier sheet containing an equal amount of the fragrance.

EXAMPLE 4

Tablets of the compositions indicated on the table below were prepared by the method outlined in Example 1; the amount of each constituent was indicated in grams. They were assessed for their sublimation properties by placing the tablet in an aluminum weighing tray, heating on a hot plate to 60° C., and determining the mass at 2 minute intervals. The results are intended to indicate a scale wherein 1="poor sublimation" and 4="good sublimation".

As can be seen from the results, blends of adamantane and cyclododecane, particularly wherein the amount of cyclodecane equalled to or exceeded the amount of adamantine, provided better sublimation characteristics.

| Example | 4-1 | 4-2 | 4-3 | 4-4 | 4-5 | 4-6 |
|---|---|---|---|---|---|---|
| adamantane | 2.3 | 2.1 | 1.8 | 1.5 | 1.2 | 0.9 |
| cyclodecane | 0.6 | 0.8 | 1.1 | 1.4 | 1.7 | 2 |
| Arquad ® 2HT | 1.5 | 1.5 | 1.5 | 1.5 | 1.5 | 1.5 |
| fragrance | 0.1 | 0.1 | 0.1 | 0.1 | 0.1 | 0.1 |
| Sublimation | 1 | 1 | 2 | 3 | 4 | 4 |

EXAMPLE 5

Tablets of the compositions indicated on the table below were prepared by the method outlined in Example 1, and the amount of each constituent was indicated in grams in the Table below. The sublimation characteristics of each example composition were assessed as outlined in Example 4. These tablets demonstrate the sublimation characteristics of different blends of sublimable materials, and demonstrate useful sublimable material blends that may be used in the formulation of a textile treatment composition according to the invention.

| Example | 5-1 | 5-2 | 5-3 | 5-4 | 5-5 | 5-6 |
|---|---|---|---|---|---|---|
| adamantane | 1.5 | — | 1.4 | — | 1.4 | — |
| cyclododecane | — | 1.5 | — | — | — | 1.5 |
| benzoic acid | — | — | 1.5 | — | — | — |
| dimethyl fumarate | 1.4 | — | — | 1.5 | — | 1.4 |
| camphor | — | 1.4 | — | 1.4 | 1.5 | — |
| Sublimation | 4 | 3 | 4 | 3 | 3 | 4 |

As can be seen from the results, various blends of sublimable materials provided good sublimation characteristics, and are expected to be useful delivery vehicles useful in the formulation of textile treatment compositions.

The invention claimed is:

1. A method of providing textile conditioning and fragrance to a fabric that is being dried in a heated drier, comprising the addition to the fabric in the drier of at least one textile conditioning composition and at least one fragrance in a sublimable carrier substance, wherein the sublimable carrier substance has a sublimation temperature in the operating temperature range of the drier and comprises adamantane.

* * * * *